US006539867B2

(12) United States Patent
Lee

(10) Patent No.: US 6,539,867 B2
(45) Date of Patent: Apr. 1, 2003

(54) METHOD OF REPLACEMENT COMPONENT COMMUNICATING WITH PRINTER AND METHOD OF PRINTER COMMUNICATING WITH REPLACEMENT COMPONENT

(75) Inventor: Beom-ro Lee, Gyeonggi-do (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/861,883

(22) Filed: May 22, 2001

(65) Prior Publication Data

US 2002/0012555 A1 Jan. 31, 2002

(30) Foreign Application Priority Data

May 22, 2000 (KR) ..... 2000-27520

(51) Int. Cl.[7] ..... B41F 1/54

(52) U.S. Cl. ..... 101/484; 400/208; 347/19; 347/50; 399/12; 399/13; 399/25

(58) Field of Search ..... 101/484, 483; 347/19, 50; 400/207, 208; 399/12, 13, 24–27

(56) References Cited

U.S. PATENT DOCUMENTS 4,961,088 A * 10/1990 Gilliland et al. ..... 399/12
6,039,430 A * 3/2000 Helterline et al. ..... 347/19
6,312,106 B1 * 11/2001 Walker ..... 347/50

* cited by examiner

*Primary Examiner*—Andrew H. Hirshfeld
*Assistant Examiner*—Minh H. Chau
(74) *Attorney, Agent, or Firm*—Sughrue Mion, PLLC

(57) ABSTRACT

A method of a replacement component used in a printer communicating with a controller of the printer, and a method of a controller of a printer communicating with a replacement component used in a printer are disclosed. The method of the replacement component communicating with the controller includes the steps of: a memory module of the replacement component deciding whether or not a predetermined password signal is in information received via a communication interface; and the memory module communicating with the controller of the printer when the password signal is in the received information. Since the replacement component for a printer is adapted to not communicate with a controller which does not transmit a preset communication allowing signal, the characteristic information of the replacement component is prevented from being leaked. In addition, it can be prevented that a bad component is installed and used in the printer.

6 Claims, 6 Drawing Sheets

METHOD OF REPLACEMENT COMPONENT COMMUNICATING WITH PRINTER AND METHOD OF PRINTER COMMUNICATING WITH REPLACEMENT COMPONENT

BACKGROUND OF THE INVENTION

1. Field of the Invention

The present invention relates to a method of a replacement component used in a printer communicating with a controller of the printer, and a method of a controller of a printer communicating with a replacement component used in a printer, and more particularly, to a method of a replacement component used in a printer communicating with the controller of the printer, in which information communication is allowed after a predetermined authorization procedure is satisfactorily performed, and a method of a controller of a printer communicating with a replacement component used in a printer.

2. Description of the Related Art

FIG. 1 is a diagram illustrating a general printer.

Referring to FIG. 1, a printer comprises a photosensitive belt 11, a discharging device 12, a charger 13, laser scanning units 14, developing units 15, a drying unit 16, a transfer unit 17, and an ink supplying unit 18.

The printing steps of the above printer will be described.

The discharging unit 12 emits light to the circulating photosensitive belt 11 to remove an electrostatic latent image remaining on the photosensitive belt 11.

The charger 13 charges the photosensitive belt 11 to a predetermined potential so that a new electrostatic latent image can be formed in the subsequent step.

The laser scanning units 14 selectively illuminate the photosensitive belt 11 to form an electrostatic latent image on the photosensitive belt 11, and the developing units 15 develop the electrostatic latent image with liquid developer.

The drying unit 16 is employed in a printer which uses a mixture of a liquid carrier and a toner as a liquid developer, and absorbs and dries the liquid carrier remaining on the photosensitive belt 11.

The transfer unit 17 transfers a toner image formed on the photosensitive belt 11 to a paper sheet 19.

The ink supplying unit 18 comprises a container 18*e* for supplying a liquid carrier to the developing units 15, and containers 18*a*, 18*b*, 18*c*, and 18*d* for storing concentrated liquid developers or toners of yellow, magenta, cyan, and black colors, respectively.

Among the devices participating in printing operations, components, such as the photosensitive belt 11, characteristics of which deteriorate as the components grow old, must be replaced at an appropriate time. However, the conditions of using the photosensitive belt 11 properly may vary with the manufacturer thereof, or the type thereof. The conditions include, for example, the potential level which must be maintained at the photosensitive belt 11 so that an electrostatic latent image can be formed on the photosensitive belt 11, the intensity of light for illuminating the photosensitive belt 11 so that an electrostatic latent image can be formed on the photosensitive belt 11, etc. Therefore, it is required that the operation conditions of individual units, for example, the discharging device 12, the charger 13, the laser scanning units 14, and the like are adjusted according to the using conditions of the installed photosensitive belt 11 after the new photosensitive belt 11 is installed in the printer. In order to meet such requirements, a memory (not shown) storing the characteristic information of the photosensitive belt 11 is supplied together with the photosensitive belt 11 for replacement so that a controller (not shown) which controls the devices of the printer can read the content of the memory. However, since the information recorded in the memory may be leaked or changed maliciously during the circulation thereof, it is necessary to limit access to the recorded information.

Another replaceable component is a developer supplying container for containing and supplying a consumable developer. The characteristics of a developer stored in a developer supplying container may vary with the manufacturer thereof, or the type thereof. When a developer supplying container provided with a memory in which information concerning the development conditions of the developer contained therein is supplied as a consumable, there is also a problem in which the information recorded in the memory may be leaked or changed maliciously during the circulation thereof.

When erroneous information is recorded in the memory supplied together with a component, a printer utilizing this information may make a printing error or an operation error.

SUMMARY OF THE INVENTION

To solve the above problems, it is an objective of the present invention to provide a method of a replacement component used in a printer communicating with a controller of the printer, and a method of a controller of a printer communicating with a replacement component used in a printer, in which recorded information concerning the new component is accessible only after a predetermined authorization procedure is satisfactorily performed.

Accordingly, to achieve the above objective, there is provided a method of a replacement component used in a printer communicating with a controller of the printer, the replacement component comprising a memory module in which predetermined information is recorded for being used by the controller of the printer, the memory module being installed on the replacement component so that the memory module can communicate with the controller via a communication interface, the method including the steps of: (a) the memory module deciding whether or not a predetermined password signal is in information received from the controller; and (b) the memory module communicating with the controller when the password signal is in the received information in step (a).

Preferably, the method further includes the steps of: the memory module counting the number of times the controller tries to communicate with the memory module by means of erroneous information, when the preset password signal does not exist in step (a); and the memory module deleting the information recorded therein when the number of trials by the controller reaches a preset value. In addition, it is preferable that in the step of deleting the information, the memory module also deletes the password information recorded therein for comparison.

In addition, to achieve the above objective, there is provided a method of a controller of a printer communicating with a replacement component used in a printer, the printer comprising the replacement component, and a controller installed at the printer so that the controller can communicate, via a communication interface, with a memory module which is provided in the replacement component and in which predetermined information is recorded, the method including the steps of: (a) the controller transmitting a preset password signal to the memory module of the installed replacement component; (b) the controller deciding whether or not a preset communication allowing signal is received from the memory module to correspond to the transmitted password signal; and (c) the controller communicating with the memory module and receiving the information recorded in the memory module when the controller decides that the communication allowing signal is received in step (b).

Preferably, the method further includes the step of the controller displaying a message that the replacement component is bad on a display device of the printer when the communication allowing signal is not received in step (b).

In addition, the method further includes the step of the controller controlling the memory module so that the communication allowing signal recorded in the memory can be changed, when the controller receives all the information recorded in the memory module in step (c).

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Figure 2:
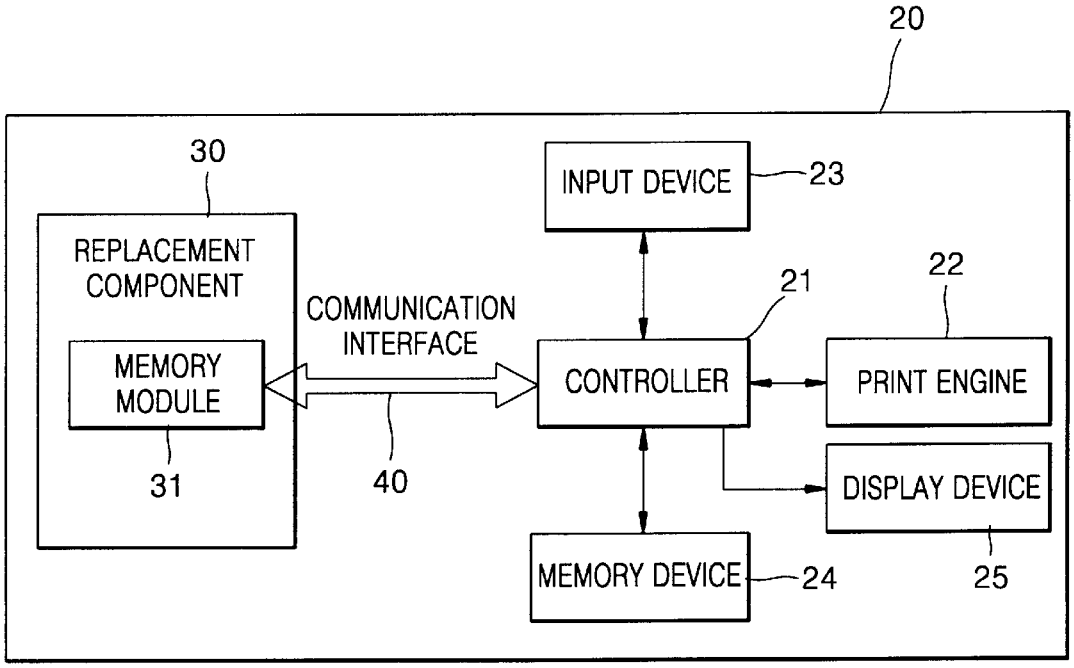
FIG. 2 is a block diagram illustrating a printer to which a method of a replacement component used in the printer communicating with the controller of the printer can be applied according to the present invention.

FIG. 2 is a block diagram illustrating a printer to which a method of a replacement component used in the printer communicating with the controller of the printer can be applied according to the present invention.

Referring to FIG. 2, a printer 20 comprises a controller 21, a print engine 22, an input device 23, a memory device 24, and a display device 25.

The controller 21 which controls the overall system of the printer 20 controls the print engine so that an image corresponding to received print data can be printed on a paper sheet, and processes a signal input from the input device 23.

The controller 21 can communicate with a memory module 31 of a replacement component 30 via a communication interface 40.

In addition, it is preferable that a sensor (not shown) which can sense whether the replacement component 30 is installed or not, is provided at the printer so that the controller 21 can discriminate whether or not the replacement component 30 is installed at the printer.

Figure 1:
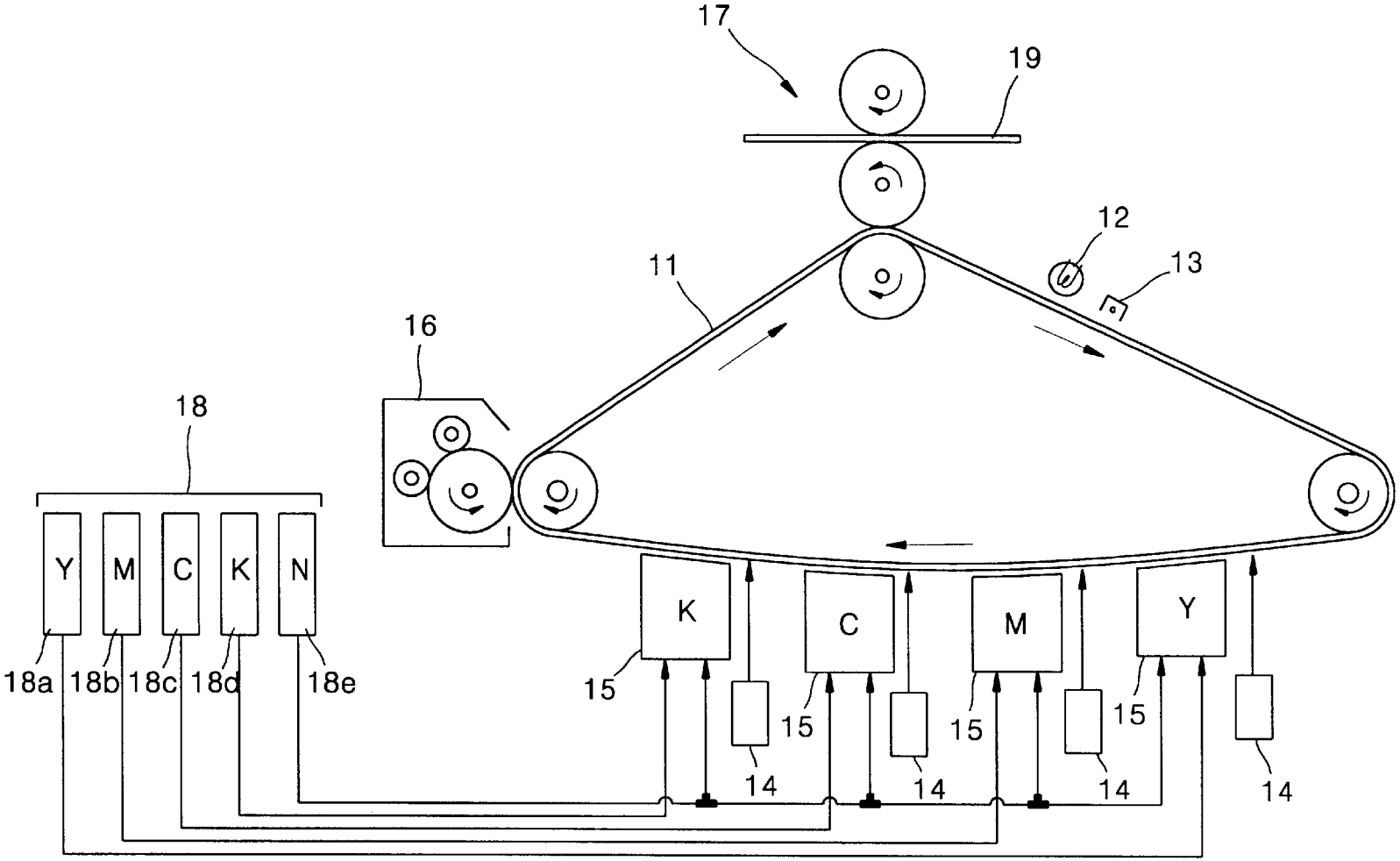
FIG. 1 is a diagram illustrating a general printer.

The print engine 22 prints an image corresponding to image data received from the controller 21 which controls the overall system of the printer, on a paper sheet. The print engine 22 includes, for example, a photosensitive belt, a charger, a discharging device, laser scanning units, developing units, a drying unit, and a transfer unit, as shown in FIG. 1.

The memory module 31 is installed at the replacement component 30.

The replacement component 30 is a component of the printer 20, and the method of the present invention can be applied to various components depending on the type of printer and the structure thereof.

The replacement component 30 which is applicable to the present invention may be any component which must be replaced when it reaches the end of its usable life, or any component which is consumed as it is used, and therefore must be supplied or replaced periodically. Examples of the replacement component 30 are a photosensitive belt, and a developer supplying container for containing a developer and supplying the developer to a printer.

The memory module 31 installed on the replacement component 30 has a structure capable of communicating with the controller 21 via the communication interface 40 when the replacement component 30 is installed at a predetermined position of the printer 20. The communication interface 40 may be a wire or wireless type.

Figure 3:
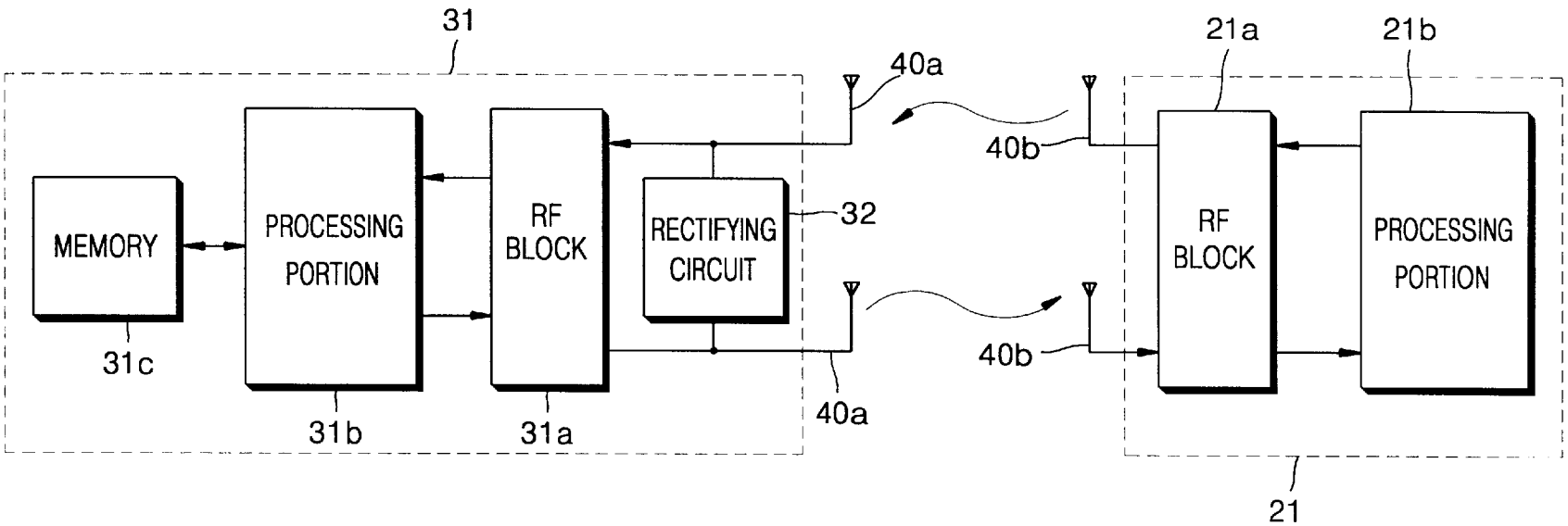
FIG. 3 is a block diagram illustrating an example of the configuration of the pair of a memory module installed on a replacement component and a controller.

An example of a memory module employing a wireless-type communication interface is shown in FIG. 3.

Referring to FIG. 3, the memory module 31 comprises a rectifying circuit 32, an RF block 31*a*, a processing portion 31*b*, and a memory 31*c*. A first antenna 40*a* is a communication interface for the memory module 31.

Figure 4:
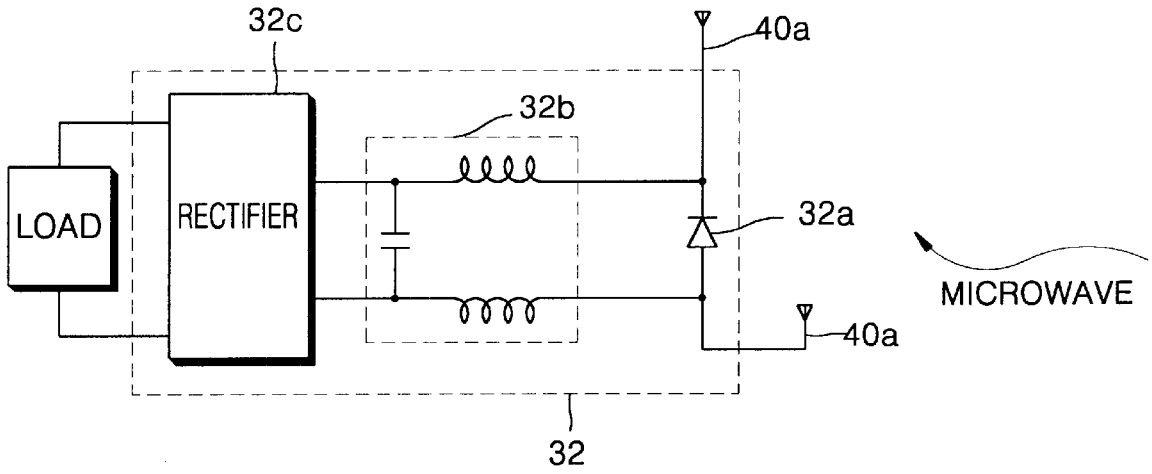
FIG. 4 is a circuit diagram illustrating an example of the rectifying circuit of FIG. 3.

The rectifying circuit 32 is designed to rectify electromagnetic waves received via the first antenna 40*a*, and to use the rectified current as the driving power of the memory module 31. Referring to FIG. 4 showing an example of the rectifying circuit 32, electromagnetic waves received by the first antenna 40*a* are rectified by a diode 32*a* and a rectifier 32*c*, and the rectifying circuit 32 is adapted to store the electrical energy. Reference numeral 32*b* denotes a low-pass filter.

The RF block 31*a* detects the signal received by the first antenna 40*a*, and modulates a carrier wave corresponding to data to be transmitted.

The processing portion 31*b* processes received information.

The characteristic information of the replacement component 30 is recorded in the memory 31*c* for using the replacement component 30 properly. For example, when the replacement component 30 is a photosensitive belt, information concerning the name, manufacturer, date of manufacture, and usable life of the photosensitive belt may be recorded in the memory 31*c*. In addition, it is preferable that control data for driving a discharging device, a charger and laser scanning units is recorded in the memory 31*c* so that the photosensitive belt can be used in the optimum conditions during printing. That is, information concerning the intensity of light for illuminating the photosensitive belt in order to remove an electrostatic latent image, the value of the potential applied to the photosensitive belt by the charger so that a new electrostatic latent image can be formed in the subsequent step, and the intensity of light emitted from laser scanning units so that an electrostatic latent image can be formed on the charged photosensitive belt when the photosensitive belt installed in the belt cartridge is recorded in the memory 31*c*.

As another example, when the replacement component 30 is a developer supplying container, characteristic information for using the developer properly is recorded in the memory 31*c*. For example, when the printer 20 has a structure in which a toner and a liquid carrier of a developer are separately supplied to the printer 30, information concerning the mixing ratio of the toner and the liquid carrier, the potential maintained between a photosensitive belt and developing units so that, when a charged toner is employed, the charged toner can be fixed to the photosensitive belt, etc. is recorded in the memory 31*c*.

In addition, a communication allowing password is recorded in the memory module 31 so that the memory module 31 can decide whether or not the memory module 31 allows an external device to read the information recorded therein, or transmits the information recorded therein to the external device.

The controller 21 includes an RF block 21*a,* and a processing portion 21*b.* A second antenna 40*b* is a communication interface for the controller 21 to communicate with the memory module 31.

The RF block 21*a* of the controller 21 modulates a carrier wave corresponding to the data transmitted from the processing portion 21*b,* and transmits the modulated signal, and demodulates the signal received by the second antenna 40*b.*

Figure 5:
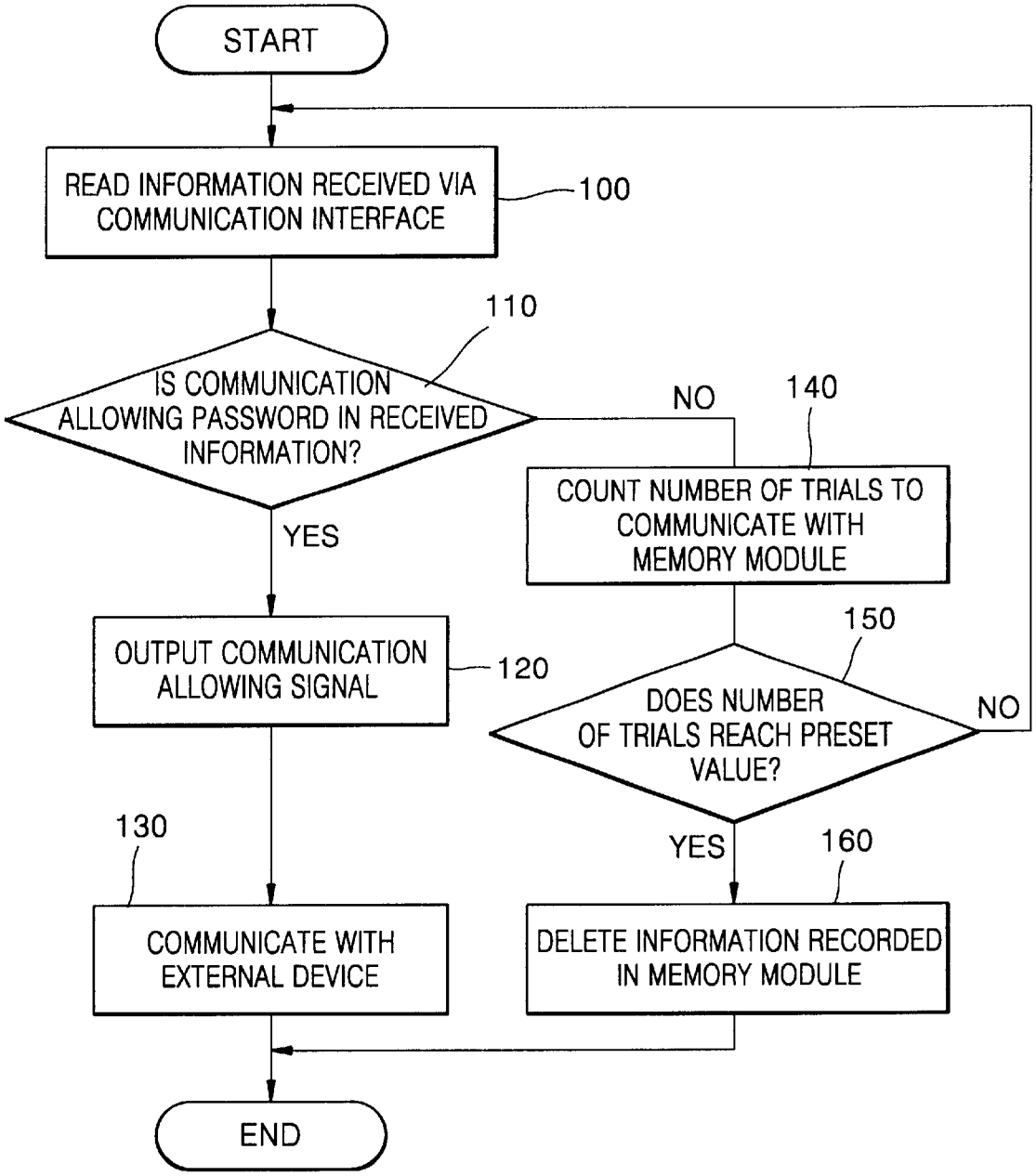
FIG. 5 is a flow chart illustrating the communicating steps of a replacement component for use in a printer according to the present invention.

The communicating steps of a replacement component according to an embodiment of the present invention will be described with reference to FIG. 5 as follows.

The memory module 31 of a replacement component 30 reads the information received via the communication interface 40 (step 100).

The memory module 31 decides whether or not a preset communication allowing password is in the information received via the communication interface 40 (step 110).

When the preset communication allowing password is in the information in step 100, the memory module 31 outputs a communication allowing signal to the external device (step 120).

The memory module 31 communicates with the external device after outputting the communication allowing signal to the external device (step 130). The communication with the external device includes transmission of the information recorded in the memory module 31.

On the other hand, when the preset communication allowing password is not in the information in step 100, the memory module 31 breaks the communication with the external device.

Preferably, when breaking the communication with the external device, the memory module 31 counts the number of times the external device tries to communicate with the memory module 31 by means of erroneous information without the communication allowing password (step 140).

In step 150, the memory module 31 decides whether or not the counted number of trials reaches a preset value. Here, since the preset value is intended to restrict unlimited trials with erroneous information, the preset value is set to have a proper value, for example, 3.

When the memory module 31 decides that the number of trials by the external device does not reach the preset value in step 150, the memory module 31 returns to step 100 and maintains a ready state capable of receiving information transmitted from an external device.

On the other hand, when the memory module 31 decides that the number of trials by the external device reaches the preset value in step 150, the memory module 31 deletes the information recorded therein (step 160). Preferably, the memory module 31 deletes the preset password information in step 160.

As described above, if the memory module 31 installed on the replacement component 30 allows only the external device which transmits the preset password signal to communicate therewith, leakage of the information recorded in the memory module 31 can be controlled. In addition, if the information recorded in the memory module is deleted when the communication allowing password is not in the information received from the external device during the preset number of trials, unwanted leakage of the information recorded in the memory module 31 can be prevented.

Figure 6:
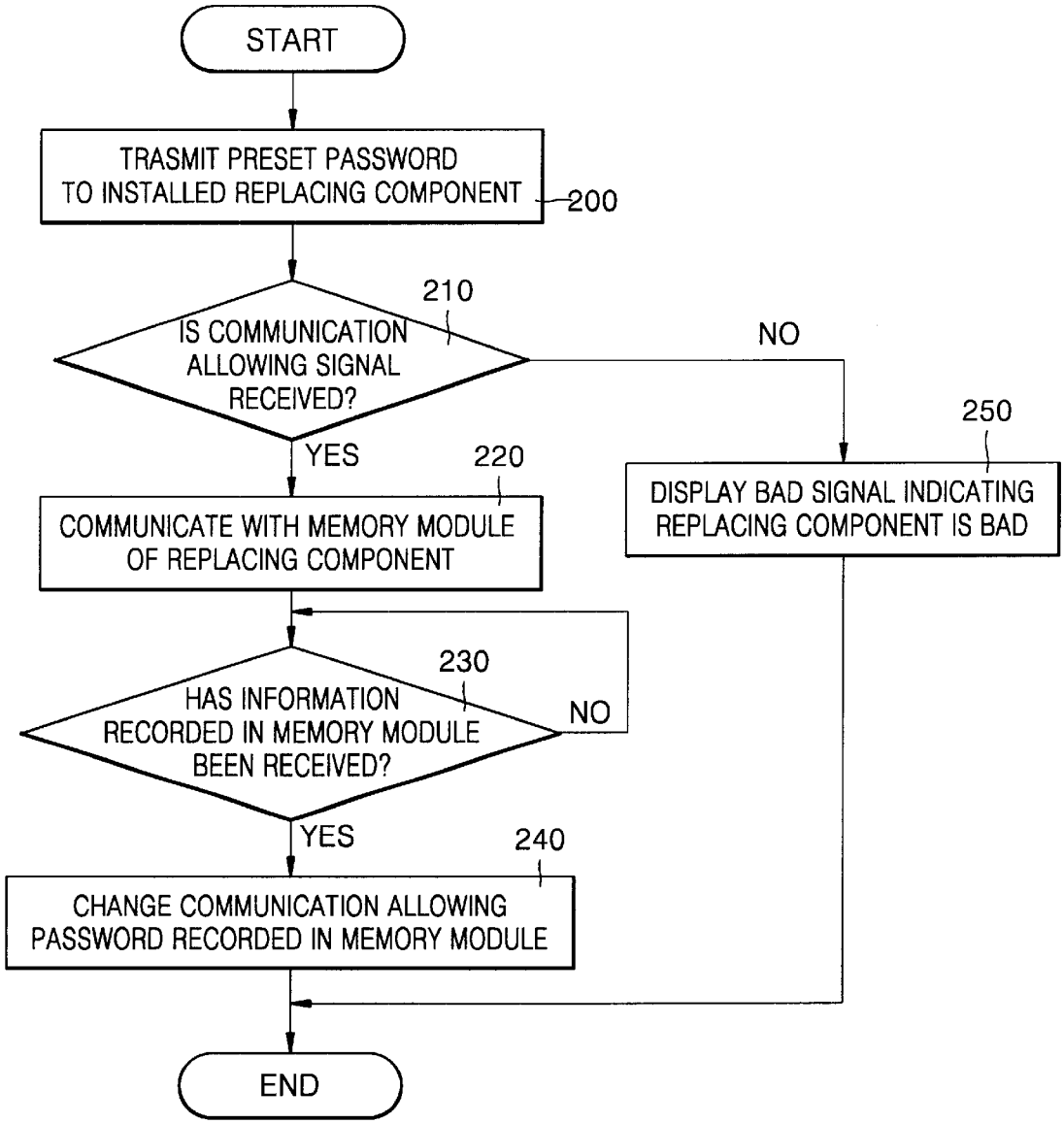
FIG. 6 is a flow chart illustrating the communicating steps of a printer with a replacement component according to the present invention.

Next, a method of a printer communicating with a replacement component will be described according to the present invention with reference to FIG. 6.

First, when the replacement component 30 is installed in the printer, a signal indicating that the replacement component 30 has been installed is input to the controller 21 from a sensor installed in order to discriminate whether or not the replacement component 30 is installed.

The controller 21 transmits a preset password signal for the installed component 30 to the memory module of the replacement component 30 via the communication interface (step 200).

Thereafter, the controller 21 decides whether or not a communication allowing signal which is preset to correspond to the transmitted password signal is received (step 210). Here, the communication allowing signal allows the controller 21 of the printer to decide whether the installed replacement component 30 is genuine or bad.

When the controller 21 decides that the communication allowing signal is not received from the memory module 31 of the installed replacement component 30 in step 210, the controller 21 considers the installed replacement component 30 to be bad, and displays a sign indicating the replacement component 30 is bad on the display device 25 (step 250).

To the contrary, when the controller 21 decides that the communication allowing signal is received from the memory module 31 in step 210, the controller 21 decides that the replacement component 30 is genuine, and communicates with the memory module 31 (step 220). In step 220, the controller 21 performs communication for receiving wanted information from the memory module 31 of the replacement component 30.

In step 230, the controller 21 decides whether or not the controller 21 receives all the wanted information from the memory module 31.

When the controller 21 decides that the controller 21 receives all the wanted information from the memory module 31, the controller 21 controls the memory module 31 so that the communication allowing signal recorded in the memory module 31 can be changed (step 240).

As described above, when the controller 21 controls the memory module 31 so that the communication allowing signal initially set in the memory module 31 of the replacement component 30 can be changed after the information recorded in the memory module 31 is once disclosed, there is the following advantage. That is, since the component 30 which has the changed communication allowing signal does not respond to the password signal of the controller 21, it can be prevented that a component which reaches the end of its usable life and is separated from the printer 20 is installed and used again. When a user installs a component 30 which has the changed communication allowing signal in the printer 20 again by mistake, the controller 21 of the printer 20 decides that the component 30 which does not respond to the preset password signal is bad. Consequently, it can be prevented that a waste component is used again.

As described above, with the method of a replacement component used in a printer communicating with a controller of the printer, and the method of a controller of a printer communicating with a replacement component used in a printer according to the present invention, since a replacement component is not allowed to communicate with a controller which does not transmit a preset communication allowing signal, the characteristic information of the component is prevented from being leaked. In addition, since the printer can decide, depending on whether or not it receives the communication allowing signal, whether or not the installed replacement component is a genuine one, it can be prevented that a bad component is installed and used in the printer.

Although the preferred embodiments of the present invention have been described, it will be understood by those skilled in the art that the present invention should not be limited to the described preferred embodiments, but various changes and modifications can be made within the spirit and scope of the present invention as defined by the appended claims.

What is claimed is:

1. A method of a replacement component for a printer communicating with a controller of the printer, the replacement component comprising a memory module in which predetermined information is recorded for being used by the controller of the printer, the memory module being installed on the replacement component so that the memory module can communicate with the controller via a communication interface, the method including the steps of:

(a) deciding, via the memory module, whether or not a predetermined password signal is in information received from the controller; and (b) communicating, via the memory module, with the controller when the password signal is in the received information in step (a).

2. The method as claimed in claim 1, wherein the method further includes the steps of:

counting, via the memory module, the number of times the controller tries to communicate with the memory module by means of erroneous information, when the preset password signal does not exist in step (a); and deleting, via the memory module, the information recorded therein when the number of trials by the controller reaches a preset value.

3. The method as claimed in claim 2, wherein in the step of deleting the information, the memory module also deletes the password information recorded therein for comparison.

4. A method of a controller of a printer communicating with a replacement component, the printer comprising the replacement component, and the controller installed at the printer so that the controller can communicate, via a communication interface, with a memory module which is provided in the replacement component and in which predetermined information is recorded, the method including the steps of:

(a) transmitting, via the controller, a preset password signal to the memory module of the replacement component;

(b) deciding, via the controller, whether or not a preset communication allowing signal is received from the memory module to correspond to the transmitted password signal; and (c) communicating, via the controller, with the memory module and receiving the information recorded in the memory module when the controller decides that the communication allowing signal is received in step (b).

5. The method as claimed in claim 4, wherein the method further includes the step of displaying, via the controller, a message that the component is bad on a display device of the printer when the communication allowing signal is not received in step (b).

6. The method as claimed in claim 5, wherein the method further includes the step of controlling, via the controller, the memory module so that the communication allowing signal recorded in the memory can be changed, when the controller receives all the information recorded in the memory module in step (c).

* * * * *